US005737884A

United States Patent [19]

Schrom

[11] Patent Number: 5,737,884

[45] Date of Patent: Apr. 14, 1998

[54] SPIRAL STAIR CASE

[76] Inventor: Wolfram Schrom, PO Box 656, Live Oak, Fla. 32060

[21] Appl. No.: 714,845

[22] Filed: Sep. 17, 1996

[51] Int. Cl.[6] ..... E04F 11/00

[52] U.S. Cl. ..... 52/187; 52/182; 52/188; 52/191

[58] Field of Search ..... 52/187, 191, 182, 52/188

[56] References Cited

U.S. PATENT DOCUMENTS

| | | | |
|---|---|---|---|
| D. 251,805 | 5/1979 | Allmand . | |
| D. 273,231 | 3/1984 | Suckno . | |
| 1,716,713 | 6/1929 | Van Rossum | 44/189 |
| 3,233,377 | 2/1966 | Blum . | |
| 3,418,770 | 12/1968 | Allmand . | |
| 3,473,275 | 10/1969 | Lappin, Jr. | 52/187 |
| 3,482,364 | 12/1969 | Albrektson et al. | 52/187 X |
| 3,513,547 | 5/1970 | Suckno . | |
| 3,727,360 | 4/1973 | Ollman | 52/187 X |
| 4,722,374 | 2/1988 | Bond | 52/187 X |
| 4,850,164 | 7/1989 | McLeod | 52/187 X |
| 5,058,339 | 10/1991 | Krstovic | 52/187 |
| 5,347,774 | 9/1994 | Smith | 52/191 X |
| 5,535,557 | 7/1996 | Garber | 52/191 X |

FOREIGN PATENT DOCUMENTS

| | | | |
|---|---|---|---|
| 2678660 | 1/1993 | France | 52/187 |

*Primary Examiner*—Wynn E. Wood

[57] ABSTRACT

A spiral stair case wherein segments of the outside stringer framework and segments of the central column are forming corresponding polygonal segments, wherein the spiral stair case preferably is made in octagonal polygonal segments, wherein one segment of the outside stringer together with one segment of the central column respectively is supporting preferably two stair treads of the the spiral stair case, wherein the segments of the outside stringer and the segments of the central column are strait, non curved elements, and wherein the stair treads are made strait and wherein all peripheral cuts are made strait, and wherein the segments are connected to each other by standard carpentry connection means, wherein the fascia, the baluster posts, the baluster filler parts and the handrail build the rigid outside stringer segments, wherein the outside stringer segments build a rigid, structural supporting outside stringer framework of the spiral stair case formed in polygonal segments and wherein the segments are connected to each other by standard carpentry connection means, and wherein the central column is formed open and wherein the top edge of the central column is functioning as an inside handrail for the spiral stair case, and wherein all single parts of the spiral stair case as the fascia, baluster posts, baluster filler parts, handrail, the central column segments, the treads, and the wooden splines and dovetail splines are made in standard carpentry craftsmanship with standard carpentry tools.

1 Claim, 6 Drawing Sheets

26
25
20
20
16
10a
15
10
20
25a
20
27
27

SECTION 1-1

SECTION 1-1

SECTION 1-1

SECTION 2-2

SECTION 2-2

SECTION 3-3

SPIRAL STAIR CASE

BACKGROUND OF INVENTION

This invention relates generally to spiral stair cases, made of wood or similar, comparable materials.

Spiral stair cases are old and well known. They are usually supported on the central column where it is necessary to provide special attachments to support the treads and/or specially made treads and where the peripheral edges of the treads are unsupported, or mostly supported only to a limited extent, and when they are supported on the outside, then with a circular stringer made from metal or laminated wood, which is not very rigid and stable and which is more labor intensive to produce.

Those structures tend to swing and wobble in use, giving a feeling of insecurity to the user. Especially in private residences where some house designs require spiral stair cases, there is a need for a solid and tastefully designed spiral stair case made out of wood or similar, comparable materials and which is simple in design and can be produced with standard carpentry means and tools.

SUMMARY OF THE INVENTION

It has been found that a spiral stair case of wood or similar, comparable materials can be made in polygonal segments wherein preferable always two treads are set into one segment of the outside stringer and accordingly into one segment of the central column, wherein these segments of the outside stringer and accordingly the segments of the central column are forming corresponding polygons. Baluster and handrail build together with the outside fascia one rigid, frame like unit, and this single units attached to each other forming a rigid, supporting outside stringer framework of the polygon segments formeing spiral staircase. The most practical form is a spiral staircase made of polygon segments with 8 sides wherein variations between 6 and 12 sides maybe useful in some situations. Those spiral stair cases are very solid and rigid and submit a secure feeling to the user. Furthermore these type of spiral stair cases are easily prefabricated in the said stringer segments, column segments and treads and because there are non curved elements and no special attachments or brackets necessary, the fabrication is simple and inexpensive and so is the assembling and installation.

DESCRIPTION OF DRAWINGS

These objects and advantages as well as other objects and advantages are attained by the device shown by way of illustration in the drawings in which.

REFERENCE NUMERALS IN DRAWINGS

Figure 1:
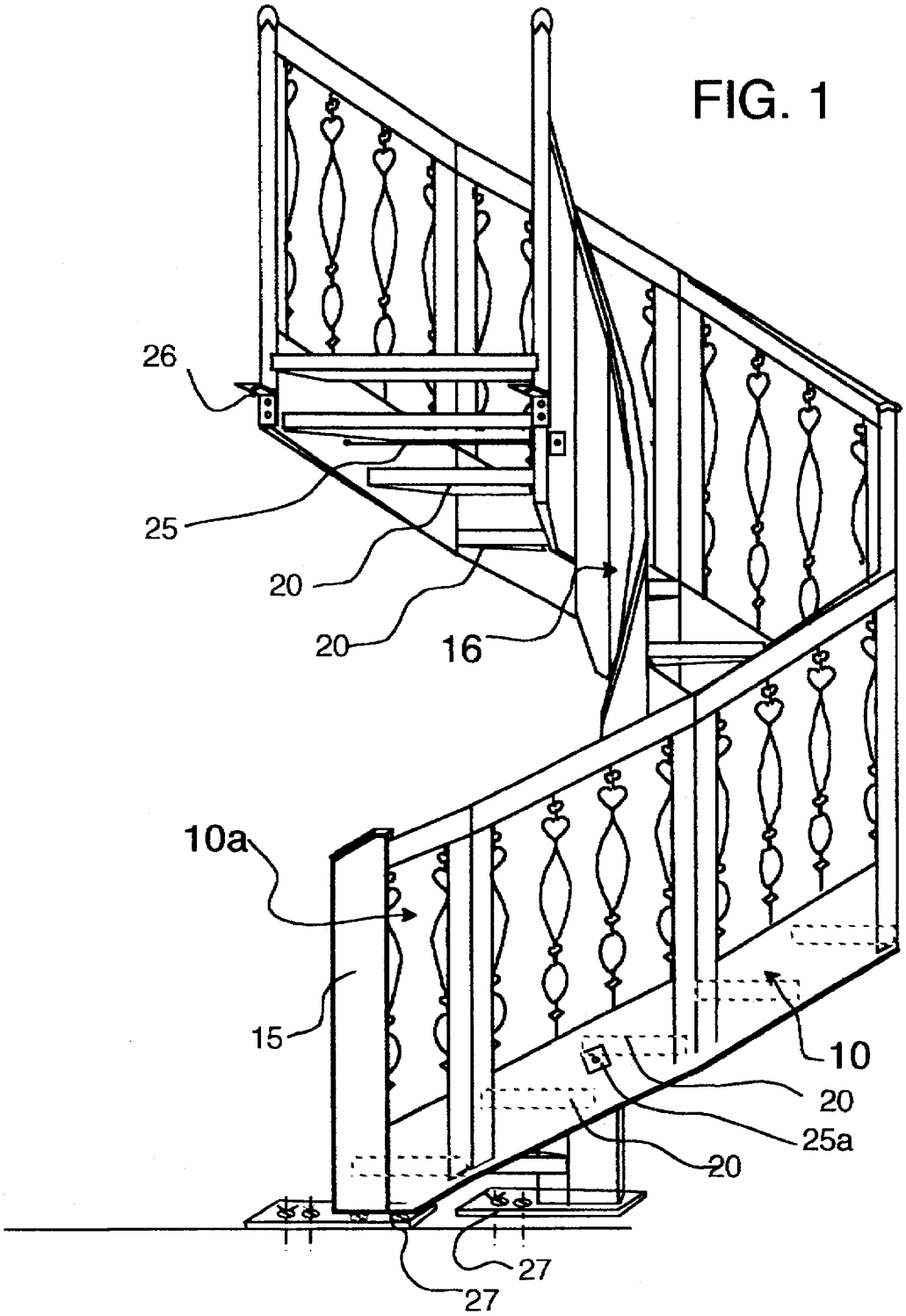
FIG. 1 is a perspective view of the spiral stair case.

10 outside striger segments
10*a* beginner segments of the outside stringer frame work
11 facia
11*a* blind grooves in fascia
11*b* notches in fascia
11*c* groove in fascia
12 handrail
12*a* groove in handrail
13 baluster filler parts
14 baluster posts
15 beginner baluster post on the outside stringer frame work
16 central column
17 standart central column segment
17*a* notches in central column segments
18 beginner central column segment
19 beginner central column segment
2O tread
21 screw
22 bolt
23 wooden spline
24 wooden dovetail spline
25 allthread bolt with washer and nut
25*a* rosette
26 standard metal ankle bracket
27 standard metal base plate

DESCRIPTION OF PREFERRED EMBODIMENT

Figure 2:
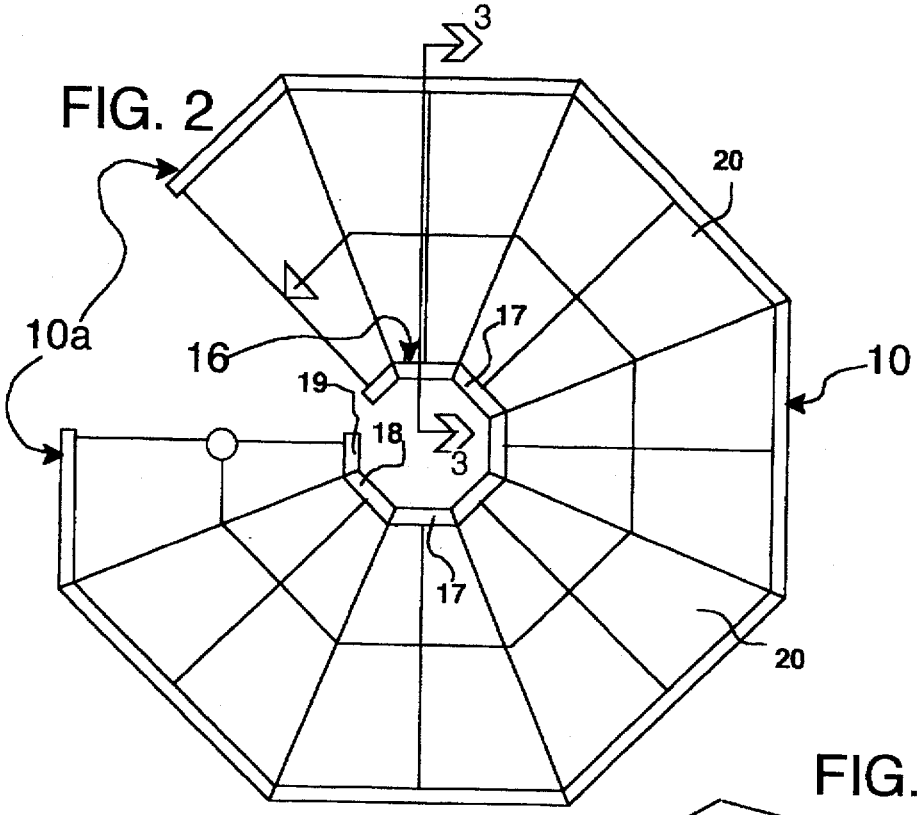
FIG. 2 is a top view of the spiral staircase, showing the typical polygon segment design with 8 sides.
Figure 2B:
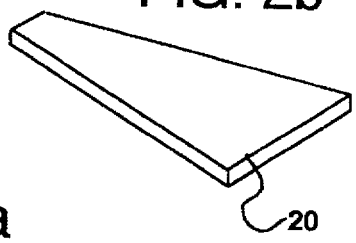
FIG. 2*b* is a perspective view of a spiral stair case tread.
Figure 2A:
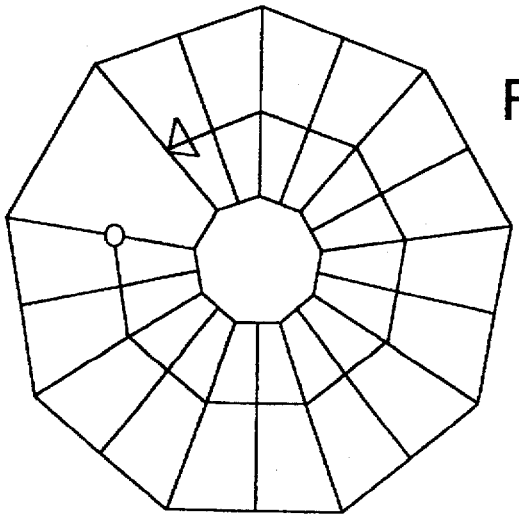
FIG. 2*a* is a variation of FIG. 2 showing a spiral stair case in a polygon segment design with 9 sides.
Figure 3:
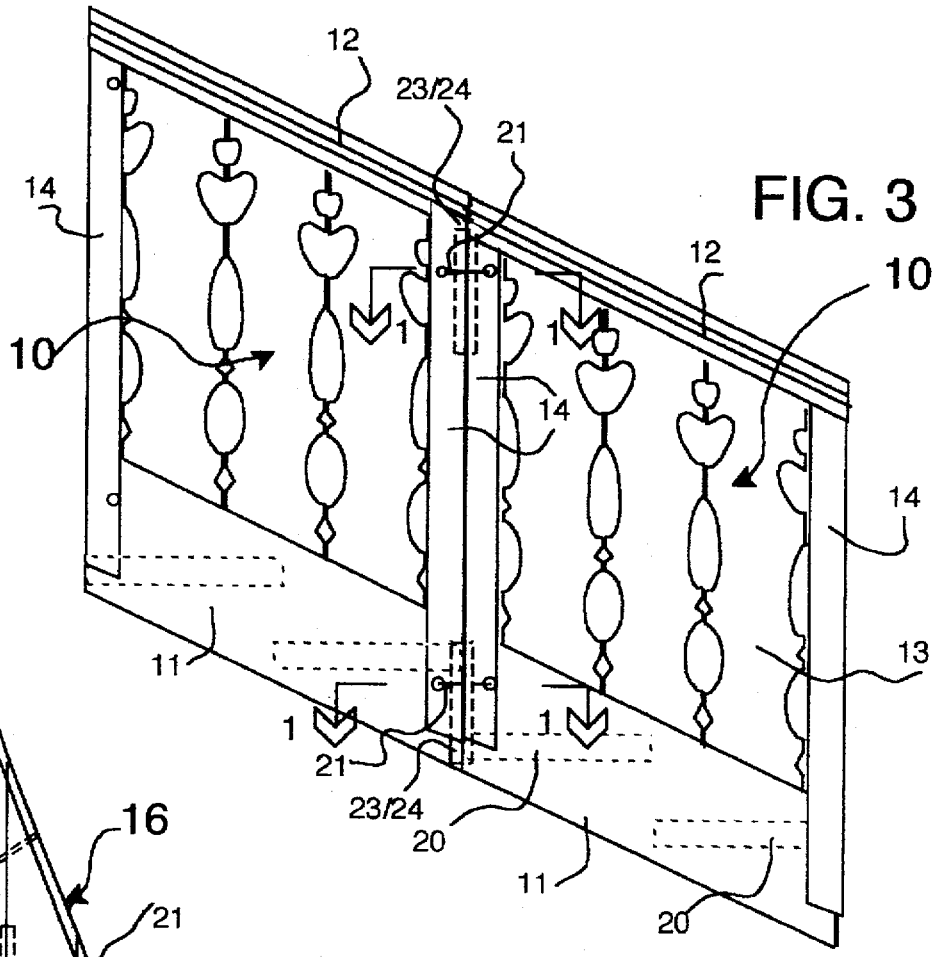
FIG. 3 shows two of the outside stringer segments and an example of a balustrade design.
Figure 4:
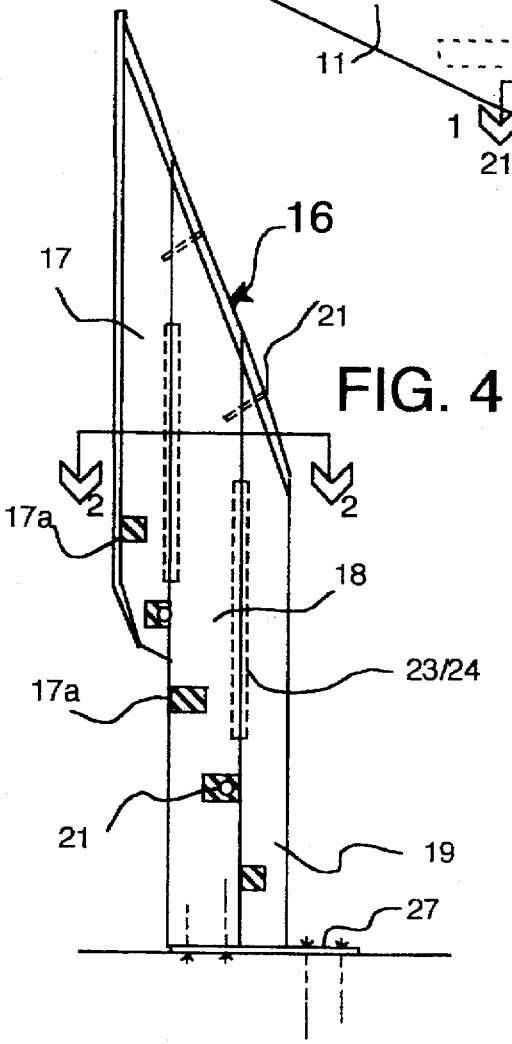
FIG. 4 shows a few of the inside column segments.
Figure 3A:
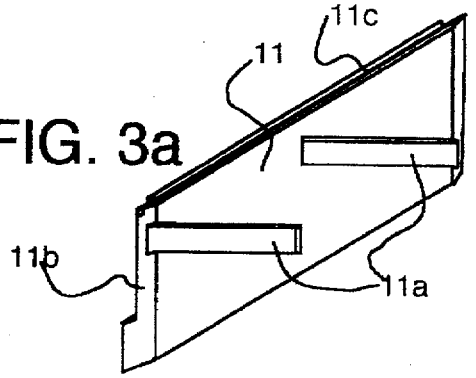
FIG. 3*a* is a perspective view of a spiral stair case fascia.

Referring now to the drawings in detail (FIG. 1), there is provided a standard metal base plate 27 to distribute part of the weight of the spiral stair case and to anchor the central column 16 to the floor. Respectively there is a standard metal base plate 2 7 to distribute the main part of the weight and live lead of the spiral stair case and to anchor the outside stringer frame work 1 0 to the floor. The central column 1 6 has the polygon segment configuration shown with 8 sides (FIG. 2), and so has the outside stringer frame work 1 0. The treads 2 0 are set in blind grooves 1 1*a* (FIG. 3*a*) in the fascia 11 and the central column segments 1 7, 18 and 1 9. Every second segment there is an all-thread bolt with washer and nut 25 bracing the spiral stair case and holding together outside stringer frame work 1 0 and central column 1 6. The wooden rosette 25*a* covers the nut and washer of the all-thread bolt 2 5 for decoration. The top of said spiral stair case is mounted with the standard metal ankle brackets 26 to the next floor or respectively landing. 15 is the beginner baluster post on the outside stringer frame work (FIG. 1). 18 and 1 9 are the beginner posts on the central column (FIG. 2 and FIG. 4).

Referring to (FIG. 2), there is shown a top view of a typical situation of said spiral stair case. The treads 2 0 together with center column 16 end outside stringer frame work 10 are building one structural frame like unit glued and bolted together with standard carpentry connecting means. The end, respectively the beginner segments of the outside stringer frame work 1 0*a* are mostly half segments and then only carry one tread.

(FIG. 3) shows two outside stringer segments 10 composed of fascia 1 1, baluster posts 14, some baluster filler parts 1 3 and handrail 1 2. These baluster filler parts 13 can be made in variations as shown, in all kind of artistic designs, or with standard baluster stacketten, or with security glass or similar materials.

Figure 5:
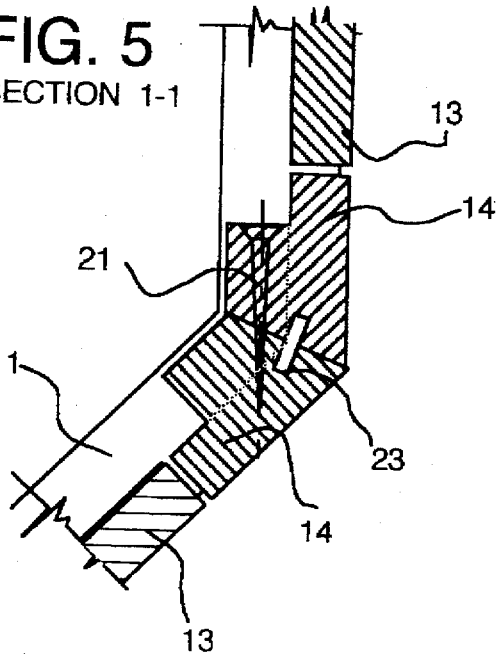
FIG. 5 shows a cross section taken on line (A—A) in FIG. 3 looking in the direction of the arrows, indicating means of connection of the outside stringer segments
Figure 5A:
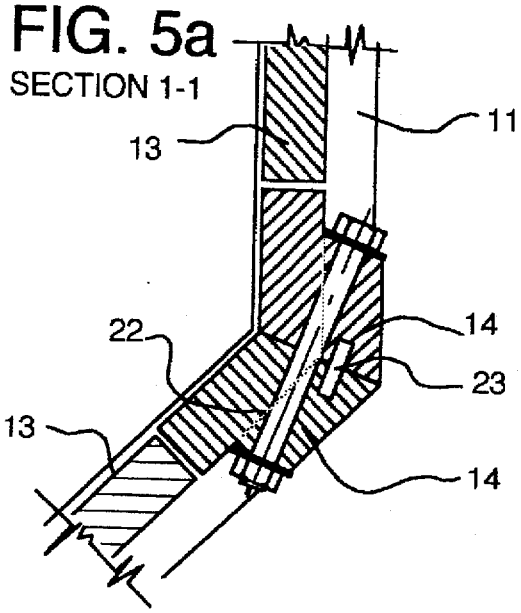
FIG. 5*a* shows a variation of the connection means shown in FIG. 5.
Figure 5B:
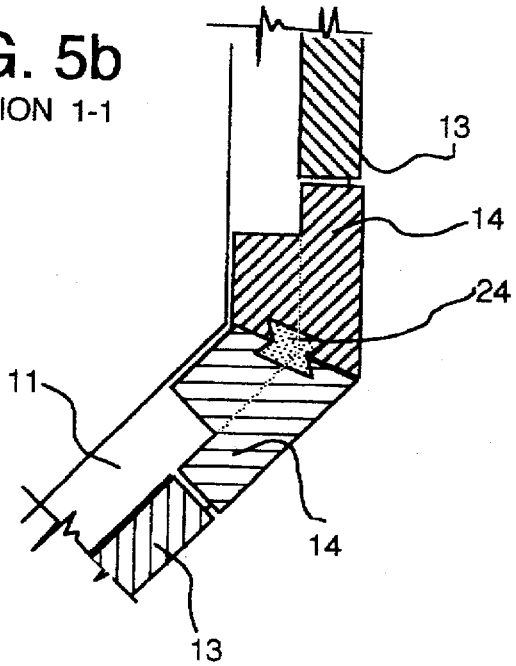
FIG. 5*b* shows another variation of the connection means shown in FIG. 5.

(FIG. 3*a*) shows a perspective view of the fascia 1 1, with the blind grooves 11*a* to hold the treads 20, the notches 11*b* to attach the baluster post 1 4 and the groove 11*c* to attach the baluster filler parts 1 3. The outside stringers 1 0 are connected to each other with wooden splines 23 and screws 2 1 as shown in (FIG. 5), cross section A—A. An alternative with wooden splines 23 and bolts 2 2 is shown in (FIG. 5*a*), and another alternative shown in (FIG. 5*b*), connects the outside stringers 10 with a wooden dovetail spline 2 4, all connections are glued in a craftsman like manner in addition to the shown connectors.

Figure 6A:
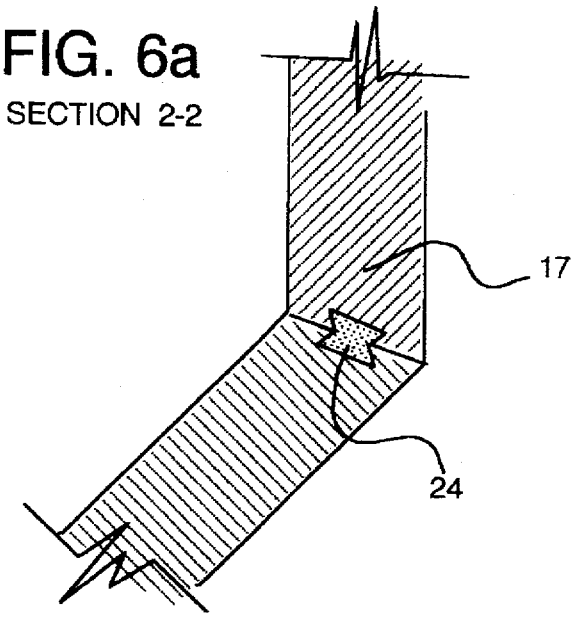
FIG. 6*a* shows a variation of the connection means shown in FIG. 6.
Figure 6:
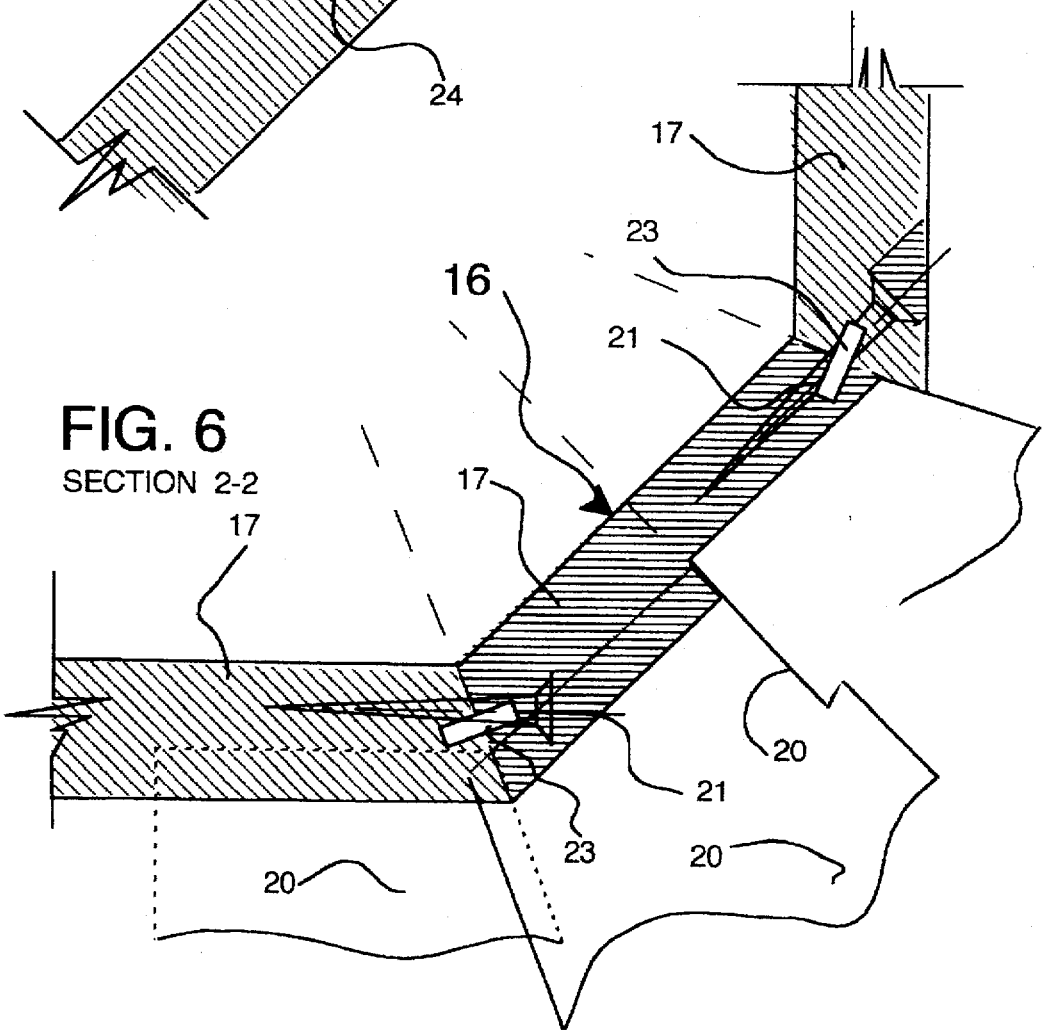
FIG. 6 shows a cross section on line (B—B) in FIG. 4 looking in the direction to the arrows, indicating means of connection of the central column segments.

(FIG. 4) shows part of the central column 16 with a standard central column segment 1 7 and beginner segments1 8 and 1 9. It shows the notches 17*a* to hold the treads 2 0. These segments are connected to each other with wooden splines 23 and screws 2 1 as shown in (FIG. 6), cross section B—B. An alternative with wooden dovetail splines 24 is shown in (FIG. 6*a*). All connections are glued in a craftsman like manner in addition to the shown connectors.

Figure 7:
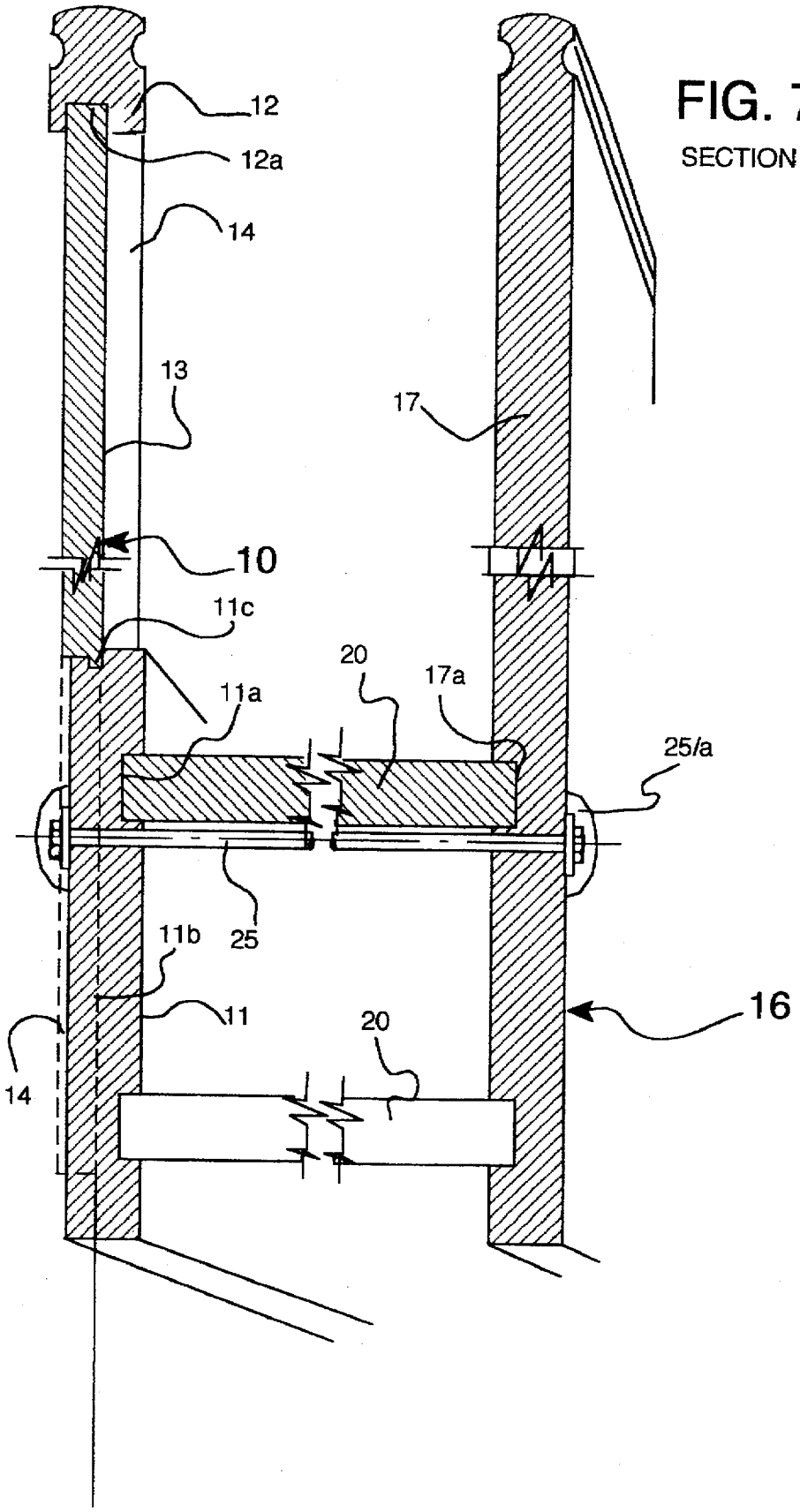
FIG. 7 shows a cross section of the spiral stair case taken on line (C—C) in FIG. 2 looking in the direction of the arrows.

(FIG. 7), shows the cross section C—C through the spiral stair case. It shows the connection between the outside stringer frame work 1 0 and the central column 1 6, wherein the all-thread bolt with washer and nut 25 and the treads 20 are the connecting elements. Wherein the treads are sitting in the blind grooves 11*a* in the fascia 11 and respectively in the notches 17*a* in the central column segments 17, 18 and 19. The handrail 12 is attached and glued to the baluster filler parts 13 in the groove 12*a*, and so are the baluster filler parts13 to the fascia 11 in the groove 1 1*c*. The baluster posts14 are glued into the notches11*b* in the fascia 1 1.

The foregoing description is merely intended to illustrate an embodiment of the invention. The component pads have been shown and described. They each may have substitutes which may perform a substantially similar function: such substitutes may be known as proper substitutes for the said components and may have actually been known or invented before the present invention. These substitutes are contemplated as being within the scope of the appended claims, although they are not specifically cataloged herein.

I claim:

1. A spiral staircase comprising an outside stringer framework formed from a plurality of joined segments, a central column formed from a plurality of joined segments, a plurality of stair treads supported between the outside stringer framework and the central column, each segment of the outside stringer framework and the central column together forming a polygonal shape with at least two of said stair treads located therebetween, the spiral staircase further comprising:

a) each segment of the outside stringer framework comprising of fascia segments, handrail means, baluster posts, and baluster filler elements all interconnected to form each of said outside stringer segments, wherein each of said fascia segments, handrail means, baluster posts, and baluster filler elements is formed from strait, non-curved elements;

b) each segment of the central column having a top edge for providing an inside handrail;

c) each stair tread being supported at opposing ends by a fascia segment of the outside stringer framework and a segment of the central column without additional stringer means therebetween.

* * * * *